US010293312B2

(12) United States Patent
Goi

(10) Patent No.: US 10,293,312 B2
(45) Date of Patent: May 21, 2019

(54) APPARATUS FOR GENERATING NANOBUBBLES

(71) Applicant: Lai Huat Goi, Singapore (SG)

(72) Inventor: Lai Huat Goi, Singapore (SG)

( * ) Notice: Subject to any disclaimer, the term of this patent is extended or adjusted under 35 U.S.C. 154(b) by 259 days.

(21) Appl. No.: 14/898,960

(22) PCT Filed: Nov. 26, 2013

(86) PCT No.: PCT/SG2013/000503
§ 371 (c)(1),
(2) Date: Dec. 16, 2015

(87) PCT Pub. No.: WO2014/204399
PCT Pub. Date: Dec. 24, 2014

(65) Prior Publication Data

US 2016/0339399 A1 Nov. 24, 2016

(30) Foreign Application Priority Data

Jun. 19, 2013 (SG) ..... 201304741

(51) Int. Cl.
*B01F 5/06* (2006.01)
*A61H 33/02* (2006.01)
(Continued)

(52) U.S. Cl.
CPC ..... *B01F 5/0658* (2013.01); *A61H 33/02* (2013.01); *B05B 3/04* (2013.01); *B05B 7/0425* (2013.01);
(Continued)

(58) Field of Classification Search
CPC ..... B01F 2003/04858; B01F 15/00935; B01F 5/0646; B01F 5/0082; B01F 5/0658;
(Continued)

(56) References Cited

U.S. PATENT DOCUMENTS 2,925,830 A * 2/1960 Kautrowitz ..... F16K 47/10 138/37
7,066,409 B2 * 6/2006 Negoro ..... B05B 1/3447 138/42
(Continued)

FOREIGN PATENT DOCUMENTS

CA 2498333 A1 * 3/2004 ..... B01F 5/061
DE 183671 * 6/1905
(Continued)

OTHER PUBLICATIONS

"Airfoil" Wikipedia published Jun. 18, 2012 accessed at <https://en.wikipedia.org/w/index.php?title=Airfoil&oldid=498220310>. (Year: 2012).*

*Primary Examiner* — Stephen Hobson
(74) *Attorney, Agent, or Firm* — Porter, Wright, Morris & Arthur, LLP

(57) ABSTRACT

An apparatus (10) for generating nanobubbles for use with fluid dispensing fittings is described. The apparatus includes a longitudinal shaft having a first end portion (12), a body (16) and a second end portion (14). The first end portion (12) and the second end portion (14) are adapted for connection with the body (16). The first end portion (12) and the second end portion (14) each includes a conical-shaped guide wherein the body comprises airfoil-shaped projecting members (19) arranged circumferentially on the outer circumferential surface of the body (16).

12 Claims, 9 Drawing Sheets

(51) Int. Cl.

| | |
|---|---|
| ***B05B 3/04*** | (2006.01) |
| ***B05B 7/04*** | (2006.01) |
| ***E03C 1/04*** | (2006.01) |
| *B01F 15/00* | (2006.01) |
| *B05B 1/34* | (2006.01) |
| *B08B 3/10* | (2006.01) |
| *E03C 1/046* | (2006.01) |

(52) U.S. Cl.
CPC ..... *E03C 1/0404* (2013.01); *B01F 15/00935* (2013.01); *B05B 1/34* (2013.01); *B08B 3/10* (2013.01); *E03C 1/046* (2013.01); *E03C 2201/40* (2013.01)

(58) Field of Classification Search
CPC ..... B01F 5/061; B01F 5/0656; B01F 5/0612; B01F 5/0645; B01F 5/0451; B01F 5/0614; B01F 5/0672; B01F 5/0676; B01F 2005/0634; B01D 3/30; B01J 19/32; B01J 2219/32279; F23D 11/102; F15D 1/0015; F15D 1/02; B23Q 11/1084; B23Q 11/10; B05B 1/34; B05B 3/04; B05B 7/0425; B24B 55/03; B08B 3/10; E03C 2201/40; E03C 1/0404; E03C 1/046; A61H 33/02
See application file for complete search history.

(56) References Cited

U.S. PATENT DOCUMENTS

| | | | | |
|---|---|---|---|---|
| 9,656,224 | B2 * | 5/2017 | Linne | A61C 9/0026 |
| 2006/0027100 | A1 * | 2/2006 | Kozyuk | B01F 3/0446 95/260 |
| 2008/0056065 | A1 * | 3/2008 | Keller | B01F 5/0612 366/339 |
| 2008/0197516 | A1 * | 8/2008 | Abe | A01K 63/042 261/75 |
| 2013/0336083 | A1 * | 12/2013 | Linne | A61C 9/0026 366/279 |
| 2014/0010040 | A1 * | 1/2014 | Hata | B01F 3/04503 366/163.2 |
| 2016/0236158 | A1 * | 8/2016 | Bauer | B01F 5/0608 |
| 2017/0197189 | A1 * | 7/2017 | Gillis | B01F 5/0473 |
| 2017/0291151 | A1 * | 10/2017 | Berglund | B01F 5/0451 |
| 2018/0023600 | A1 * | 1/2018 | Komazawa | B01F 5/0612 239/463 |

FOREIGN PATENT DOCUMENTS

| | | | | | |
|---|---|---|---|---|---|
| DE | 1064327 | B | * | 8/1959 | |
| DE | 1198327 | B | * | 8/1965 | |
| DE | 202012009704 | U1 | * | 1/2014 | |
| EP | 0678329 | A1 | * | 10/1995 | B01F 5/061 |
| EP | 1036588 | A1 | * | 9/2000 | B01F 5/061 |
| EP | 1114670 | A1 | * | 7/2001 | |
| EP | 1676685 | A2 | * | 7/2006 | B01F 3/04453 |
| EP | 1716918 | A1 | * | 11/2006 | B01D 53/8631 |
| EP | 2671631 | A1 | * | 2/2013 | B01F 3/04503 |
| EP | 2764909 | A2 | * | 8/2014 | |
| EP | 2915581 | A1 | * | 9/2015 | B01F 5/0451 |
| EP | 3093066 | A1 | * | 11/2016 | B01F 5/0606 |
| EP | 2764909 | A3 | * | 7/2017 | |
| EP | 2671631 | A4 | * | 4/2018 | |
| FR | 1208771 | A | * | 2/1960 | |
| FR | 2301281 | A1 | * | 9/1976 | |
| FR | 2864144 | A1 | * | 6/2005 | B01F 3/02 |
| JP | 48103772 | | * | 12/1973 | |
| JP | 5644031 | | * | 4/1981 | |
| JP | 5644032 | | * | 4/1981 | |
| JP | 2007021343 | A | | 2/2007 | |
| JP | 2010172800 | A | | 8/2010 | |
| JP | 2013034953 | A | | 2/2013 | |
| SU | 1230655 | A1 | * | 5/1986 | |
| SU | 1650228 | A1 | * | 5/1991 | B01F 5/0609 |
| WO | WO-2005077506 | A1 | * | 8/2005 | B01D 53/18 |
| WO | WO-2009070451 | A1 | * | 6/2009 | B01F 5/061 |
| WO | WO-2011121631 | A1 | * | 10/2011 | B01F 3/04503 |
| WO | WO-2014122592 | A1 | * | 8/2014 | B01J 20/28014 |
| WO | WO-2014184585 | A2 | * | 11/2014 | C02F 1/74 |

* cited by examiner

APPARATUS FOR GENERATING NANOBUBBLES

FIELD OF THE INVENTION

The present invention relates generally to an apparatus for generating nano bubbles, particularly it relates to an apparatus for generating nanobubbles for use with fluid dispensing fittings or sanitary fittings.

BACKGROUND

In recent years, micro bubble and nanobubble technologies have drawn widespread attention due to their wide-ranging applications in many industries, for example, health care, agriculture, aquaculture, water treatment, and the medical industry. Micro bubbles and nanobubbles are generally referred to as gas bubbles disposed within a fluid such as water. While micro-bubbles can remain suspended in water for some time, it has been suggested that nanobubbles are capable of remaining suspended in water for a relatively longer period of time. A micro bubble measures approximately less than 100 microns ($10^{-6}$) or 0.004 inches in diameter while a nanobubble may measure less than 1 microns. In the context of this application, micro bubbles, micro-nano bubbles or nanobubbles may be referred to as ultra tiny bubbles.

Due to an increase in negative ion concentration around the gas-water interface of a micro bubble or nanobubble, micro or nanobubbles are capable of attracting dirt, debris, impurities and bacteria effectively. When the gas within these ultra tiny bubbles dissolves and collapse within the water, the bubbles disappear. During the collapse, the ultra tiny bubbles release free-radical oxygen ions and generate heat energy, which are effective in neutralizing the dirt, debris, impurities and bacteria it attracts and thereby providing the end user or the object surface with an improved cleaning experience. These advantageous properties of ultra tiny bubbles have been used in the area of consumer healthcare where micro bubble or nano bubble water therapy is increasingly gaining widespread acceptance due to its benefits to human health and skin care. In addition, due to the size and suspension of the ultra tiny bubbles in water, they are capable of being absorbed by the pores of the skin upon contact and the absorption of the ultra tiny bubbles in the skin cleans the pores, increases the amount of oxygen within the skin and improves blood circulation.

In the agricultural industry, the use of large amounts of water and harmful chemicals on the plants for improving yield and productivity can be mitigated by the use of micro bubble or nanobubble technology. The extended suspension rate of ultra tiny bubbles in water allows an increase in the amount of oxygen reaching the crops and plants, thereby improving yield and productivity. Similarly, this property has been used to great advantage in aquaculture to provide increased oxygen concentration in the water for the fishes and plants.

There are some common methods available for generating ultra tiny bubbles. The principal methods of generating bubbles are by cutting gas with turbulent flows in a mixture of gas and liquid, pressurized dissolution where a gas is forcibly dissolved into a liquid with compressor, ultrasonic or impulse waves. For exam*, U.S. Pat. No. 8,201,811 uses a pressurized dissolution method to generate micro bubbles in a hydrotherapy bathing system. A liquid is drawn from a reservoir through a suction fitting affixed to the reservoir by a high-pressure pump. A gas is drawn through an injecting device using the Venturi principle. The drawn gas and liquid are mixed in a pressure vessel under positive pressure. A mixing nozzle located in the internal cavity of the pressure vessel will cause the pressurized mixed liquid and dissolved gas to be distributed to a micro bubble jet in which micro bubbles are produced. The hydrotherapy bathing system requires complicated pressurizing elements and equipment to generate microbubbles, leading to high maintenance costs and frequent servicing.

Accordingly, it is desirable to provide an apparatus for generating nano bubbles that addresses the above problems. Additionally, it is desirable provide a solution that overcomes the above disadvantages or at least provide an apparatus that addresses the above problems.

SUMMARY OF INVENTION

According to a first aspect of the present invention, there is provided an apparatus for generating nanobubbles for use with fluid dispensing fittings, the apparatus comprising, a longitudinal shaft having a first end portion, a body and a second end portion, the first end portion and the second end portion adapted for connection with the body, the first end portion and the second end portion each having a conical-shaped guide. The body comprises a plurality of disc members, each of the plurality of disc members adapted for connection with one another to form the body, and airfoil-shaped projecting members arranged circumferentially on the outer circumferential surface of each of the plurality of disc members.

Preferably the body further includes a plurality of disc members, each of the plurality of disc members adapted for connection with one another to form the body.

According to a second aspect of the present invention, there is provided an apparatus for generating nanobubbles for use with sanitary fittings, the apparatus comprising a tubular member having an inlet and an outlet for fluid communication with the sanitary fittings. It also includes a longitudinal shaft arranged within the tubular member, the longitudinal shaft having a first end portion, a body and a second end portion, the first end portion and the second end portion adapted for connection with the body and the first end portion and the second end portion each having a conical-shaped guide. The body further comprises a plurality of disc members arranged within the tubular member, each of the plurality of disc members adapted for connection with one another to form the body and airfoil-shaped projecting members arranged circumferentially on the outer circumferential surface of each of the plurality of disc members.

Preferably, the airfoil-shaped projecting members on each of the plurality of disc members are disposed circumferentially at a predetermined interval from one another.

Preferably, the airfoil-shaped projecting members on each of the plurality of disc members are disposed circumferentially such that the projecting members do not overlap one another.

Preferably, the airfoil-shaped projecting members protrude radially outward from the outer circumferential surface of each of the plurality of disc members.

Preferably, each of the airfoil-shaped projecting members includes a leading edge, wherein the leading edge is inclined at an angle of approximately 75 degrees with respect to a longitudinal axis of the body.

Preferably, each of the airfoil-shaped projecting members on each of the plurality of the discs includes a chord line, wherein the chord line is inclined at an angle of approximately 15 degrees with respect to a longitudinal axis of the disc.

Preferably, the chord line of each of the airfoil-shaped projecting members is the line joining the leading edge and a trailing edge.

Preferably, the longitudinal shaft further includes a linking member adapted for connecting the first end portion, the body and the second end portion of the longitudinal shaft together.

Preferably, the linking member is a rod insertable through a throughhole disposed axially on each of the plurality of the disc members, and each end of the rod is adapted for connection to the first end portion and the second end portion of the longitudinal shaft.

Preferably, each of the plurality of disc members further includes a first mating portion and a second mating portion and the first mating portion of the each of the plurality of disc members is configured to couple with the second mating portion of an adjacent disc member.

Preferably, the first mating portion includes a threaded inner circumferential surface at one end of the disc member and the second mating portion includes a threaded projecting member at the other end of the disc member, wherein the first mating portion is configured to receive the second mating portion.

Preferably, the first end portion and the second end portion of the longitudinal shaft are configured for coupling with the body through an interference fit.

Preferably, the tubular member further includes a first connecting member associated with the inlet and a second connecting member associated with the outlet, wherein the first connecting member is configured to couple with the second connecting member.

Preferably, the first connecting member includes a first threaded end portion positioned at the opposite end of the inlet and the second connecting member includes a second threaded end portion at the opposite end of the outlet.

Preferably, the first threaded end portion is disposed on the outer circumferential surface of the tubular member and the second threaded end portion is disposed on the inner circumferential surface of the tubular member.

Preferably, the first threaded end portion is disposed on the inner circumferential surface of the tubular member and the second threaded end portion is disposed on the outer circumferential surface of the tubular member.

Preferably, the proximal end of the tubular member is tapered in a direction towards the inlet, wherein the proximal end of the tubular member has a shape complementary to the conical-shape guide of the longitudinal shaft.

Preferably, the proximal end of the tubular member is tapered in a direction towards the outlet, wherein the proximal end of the tubular member has a shape complementary to the conical-shape guide of the longitudinal shaft.

Preferably, the inlet and the outlet of the tubular member is threaded on the outer circumferential surface of the inlet and the outlet for connection with the sanitary fitting.

The invention will now be described in detail with reference to the accompanying drawings.

BRIEF DESCRIPTION OF THE DRAWINGS

The accompanying figures illustrate disclosed embodiments) and serve to explain principles of the disclosed embodiment(s). It is to be understood, however, that these drawings are presented for purposes of illustration only, and not for defining limits of the application.

FIG. 2(*b*) is a graph showing the number of cycles completed for the apparatus in accordance with an embodiment of the invention;

Exemplary, non-limiting embodiments of the present application will now be described with references to the above-mentioned figures.

DETAILED DESCRIPTION

In the following description, the detailed embodiments of the present invention are described herein. It shall be apparent to those skilled in the art, however, that the embodiments are not intended to be limiting to the embodiments described but merely as the basis for the claims and for teaching one skilled in the art how to make and/use the invention. Some details of the embodiments are not described at length so as not to obscure the present invention.

Figure 1:
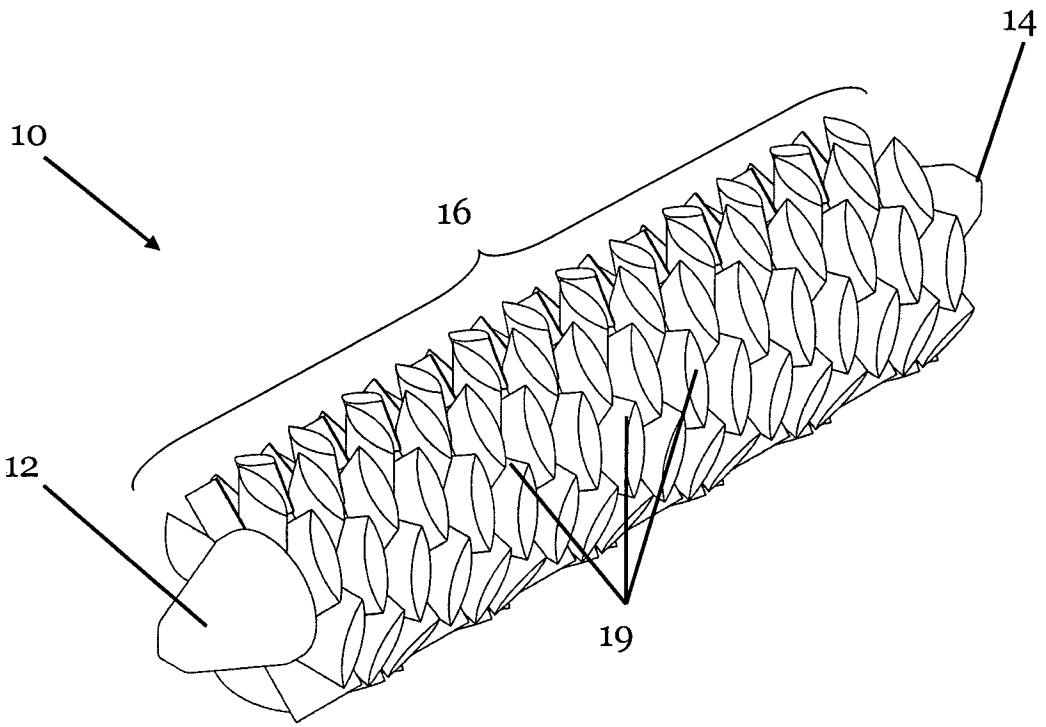
FIG. 1 is a perspective view of an apparatus for generating nanobubbles in accordance with an embodiment of the invention.

FIG. 1 is a perspective view showing an embodiment of an apparatus for generating nanobubbles for fluid dispensing fittings. The apparatus 10 includes a longitudinal shaft having a body 16, first end portion 12 and a second end portion 14. The body is cylindrical. The first end portion 12 and the second end portion 14 include a conical-shaped guide. The diameter of the conical shaped guide tapers away from the body. The conical-shaped guide includes but is not limited to a frustoconical shape. In an embodiment of the invention, the conical-shaped guide can be a boss cap. The purpose of the conical-shaped guide is to streamline fluid flow from the fluid dispensing fittings to and from the cylindrical body 16 and to reduce energy loss, details of which will be provided later. The first end portion 12 and the second end portion 14 can be adapted for connection with the ends of the longitudinal shaft. One way of connecting the first end portion 12 to the longitudinal shaft can be by way of a mating portion on the first end portion 12 or the second end portion 14 configured for coupling with the end of the longitudinal shaft. The first end portion 12 can also include a threaded inner circumferential surface (not shown) for fastening onto a threaded end (not shown) of the longitudinal shaft.

As mentioned earlier, the apparatus 10 can be used for fluid dispensing fittings. It is envisaged that in the context of this invention, fluid dispensing fittings include but is not limited to water faucets, sanitary fittings and the like, laundry sink baths, bathtubs, shower heads, spas, pools, aquariums, plumbing-related devices, agriculture-related pipe fittings or aquaculture-related pipe fittings. In addition, fluid dispensing fittings are defined as fittings capable of having an inlet and outlet for the flow of fluid there through. The apparatus 10 can be adapted for connection with the fluid dispensing fittings for fluid communication.

The longitudinal shaft can be a unitary or a singular cylindrical body 16 which includes air-foil shaped projecting members 19 which protrude radially from the longitudinal shaft. The first end portion 12 and the second end portion 14 are adapted for connection to the ends of the longitudinal shaft. The air-foil shaped projecting members 19 are arranged in a predetermined manner on the outer circumferential surface of the longitudinal shaft, which will be elaborated in further detail.

Figure 2A:
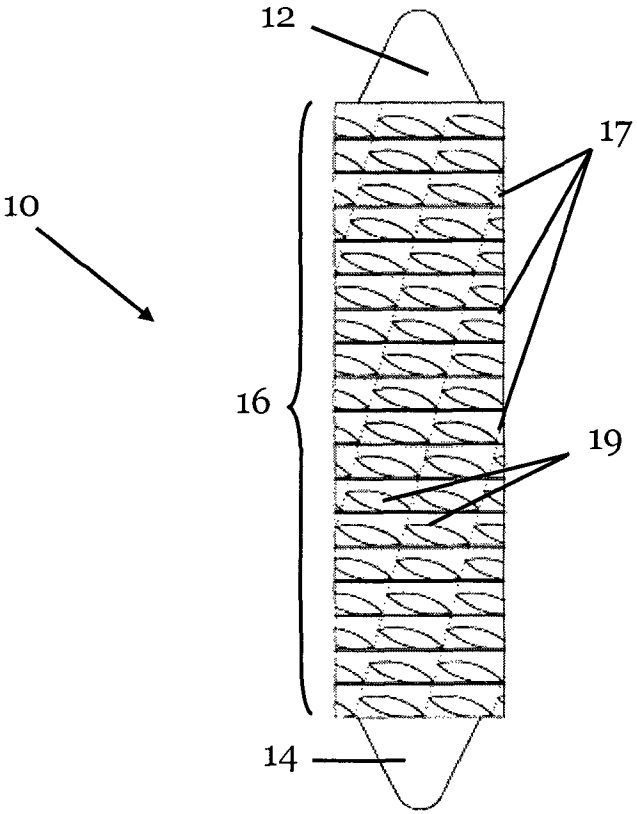
FIG. 2(*a*) is a plan view of the apparatus for generating nanobubbles in accordance with an embodiment of the invention.
Figure 2B:
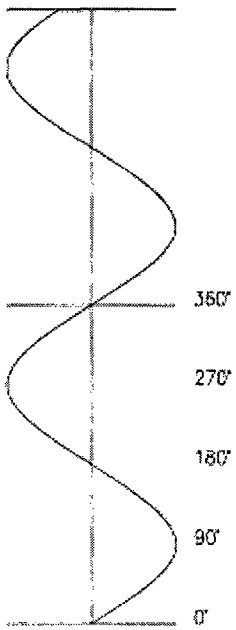
Figure 8:
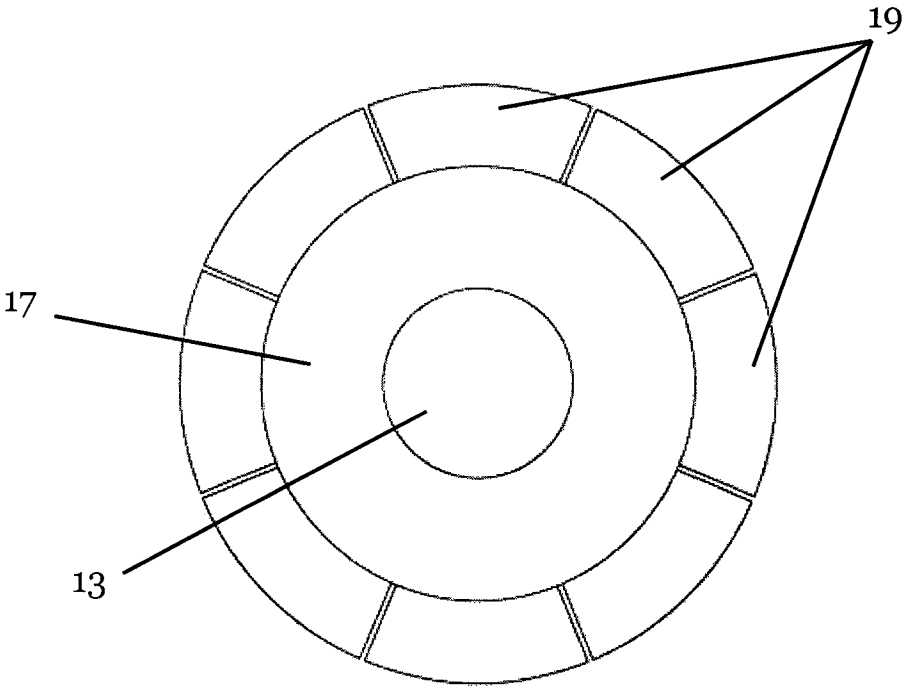
FIG. 8 is a plan view of the disc member in accordance with an embodiment of the invention.

FIG. 2(*a*) shows a side view of the apparatus 10. In this embodiment, the body 16 includes a plurality of disc members 17. Each of the disc members 17 includes air-foil shaped projecting members 19 protruding radially from the outer circumferential surface of the disc member 17. Each of the disc members 17 has a slim and flat profile relative to the diameter of the disc member. In a further embodiment of the invention, an impeller which has airfoil-shaped projecting members and a disc member can also be used. The dimensions of the disc member can vary according to the purpose it is used for. For example, in sanitary fittings or plumbing fittings, the diameter of the disc member can be less than 2 inches, while if it used in a pool or submerged underwater, the diameter of the disc member can be up to or more than 6 inches. However, a skilled person would understand that the dimensions of the disc member would not be limited to the aforesaid examples but can encompass a range of diameters depending on the application it is used for. The air-foil shaped projecting members 19 are arranged in a predetermined manner on the outer circumferential surface of the disc member 17. In one embodiment, the air-foil shaped projecting members are disposed on the outer circumferential surface of the disc member 17 or the body 16 such that the projecting members 19 do not overlap each other. The body 16 can be assembled by connecting eighteen disc members together. A skilled person would understand that although 18 disc members are used, the number of disc members can vary according to the use and purpose. FIG. 8 shows a plan view of the disc member 17 or of the body 16 where the air-foil shaped projecting members 19 do not overlap each other, leaving a slight gap in between, each projecting member 19. There are eight air-foil shaped projecting members 19 located on the outer circumferential surface of the disc member 17 or body 16. It is envisaged that a skilled person would understand that the number of air-foil shaped projecting members is not limited to eight but can vary. FIG. 2(*b*) shows a sinusoidal wave illustrating the relationship of the sinusoidal wave with respect to the fluid flow on the circumferential surface of the cylindrical body 16 or the disc members 17. To achieve an efficient generation of nano bubbles from the apparatus 10, fluid flow through the longitudinal shaft can comprise less than two cycles. The principles and operation of the fluid flow through the longitudinal shaft and the air-foil shaped projecting members will be explained in further detail.

Figure 3:
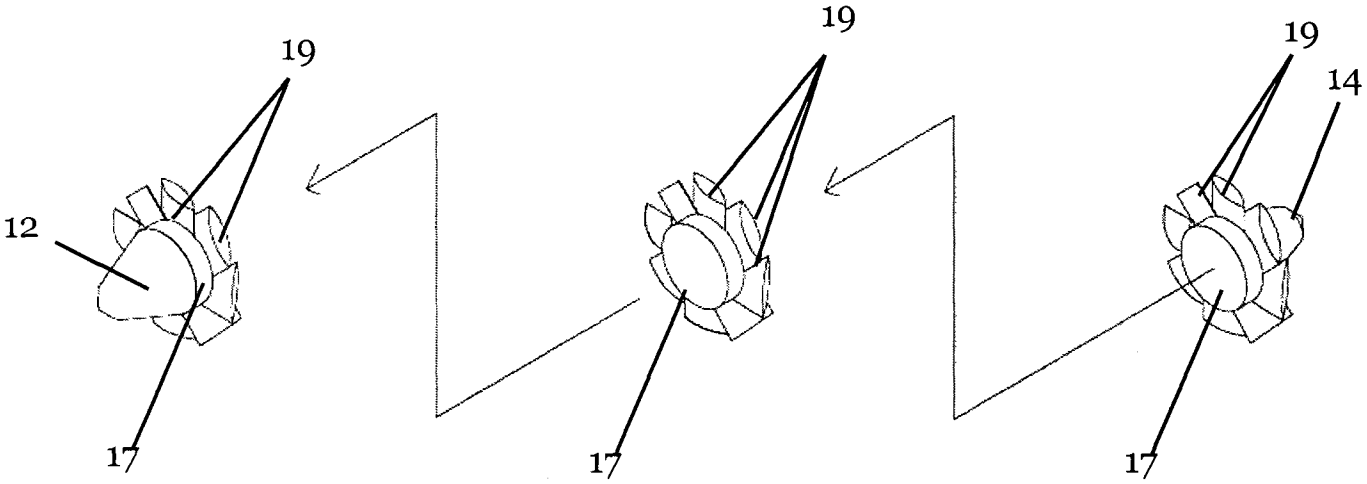
FIG. 3 is perspective view of an assembly portion of the apparatus in accordance with an embodiment of the invention.

FIG. 3 illustrates a partial assembly view of the longitudinal shaft having the first end portion 12, the second end portion 14 and some of the plurality of disc members 17 forming the cylindrical body 16. There are advantages in using a plurality of disc members 17 to form the cylindrical body 16. The disc members 17 allow flexibility in assembling a longitudinal shaft suited for its desired purpose and objectives. For example, if the disc members are to be used in a shower head, the number of disc members can be maximised within the shower handle to efficiently generate nano bubbles for the maximum benefit of the user. In another example, if the disc members are to be used for aquaculture related fluid dispensing fittings submerged under water, the number of disc members can similarly be customised to generate the nano bubbles suited for the purpose of providing improved oxygen concentration to the living plants and fishes in its locale. In addition, the disc members can be easily manufactured as one moulding die is required for the manufacture of the disc members. It is also easily assembled by the end user by virtue of their ease of connection to each disc member to form the body.

In order to ensure that the disc members 17 are held together in a fixed manner to ensure efficient generation of nano bubbles, various ways of coupling the disc members to form the longitudinal shaft are possible. For example, the first end portions 12 and the second end portions 14 are capable of receiving a linking member. The linking member can be a rod member (not shown). The rod member is insertable through a throughhole of each of the disc members to hold the disc members together. The throughhole is located at the centre of the disc member 17. In another embodiment, each of the disc members 17 has a first mating portion and a second mating portion at each end of the disc member 17 where it contacts an adjacent disc member 17. The first mating portion and the second mating portion are complementary to each other such that either mating portion can receive the other mating portion so as to couple the first mating portion of the disc member 17 and the second mating portion of the adjacent disc member together. An example of complementary mating portions can be threaded ends which can be easily screwed for connection. Another example of complementary mating portions involve a protruding member and a complementary recess for receiving the protruding member.

Figure 4:
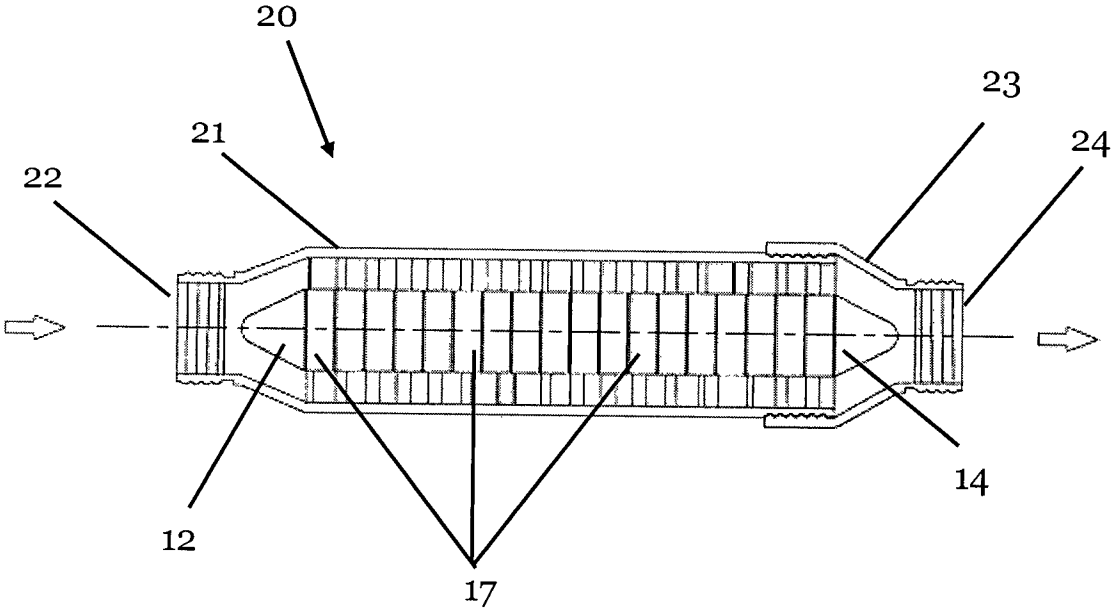
FIG. 4 is cross sectional view of the apparatus in accordance with an embodiment of the invention.
Figure 5:
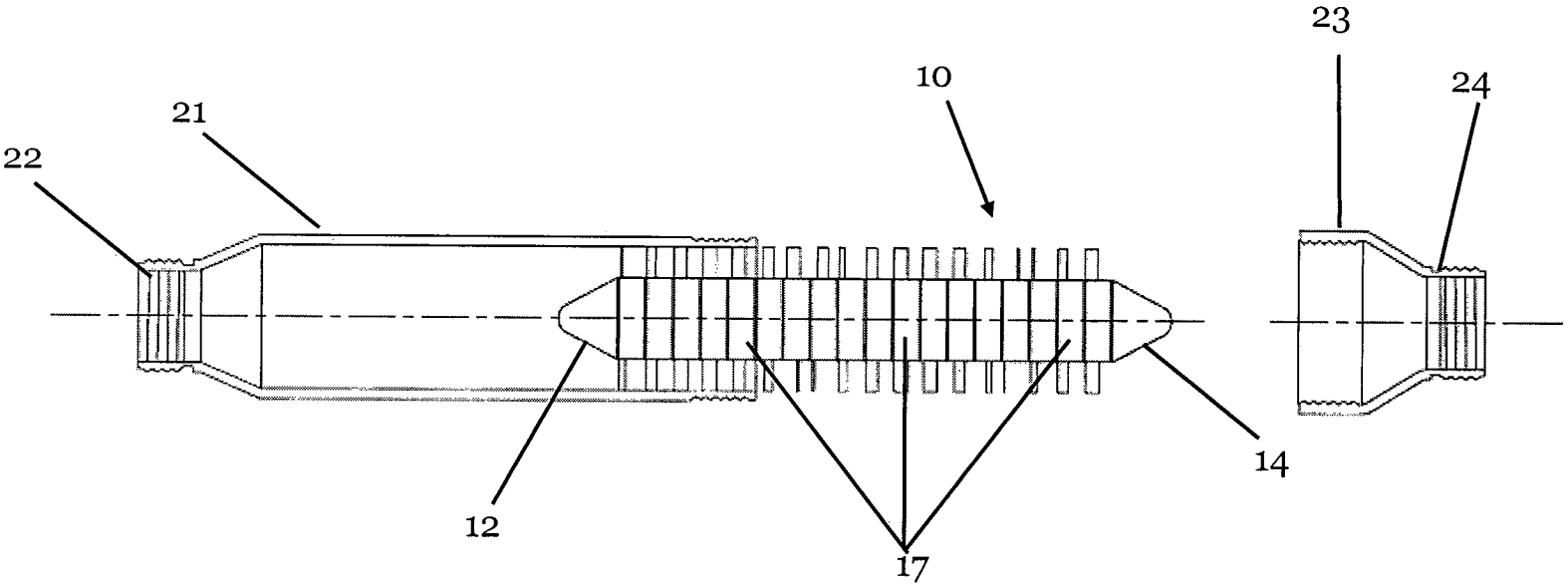
FIG. 5 is a cross sectional view of the apparatus in disassembled form in accordance with an embodiment of the invention.

FIG. 4 illustrates a cross-sectional view of another embodiment of the present invention where the apparatus 10 further includes a tubular member 20 having an inlet 22 and outlet 24 for fluid communication with fluid dispensing fittings or sanitary fittings. The longitudinal shaft is enclosed within the tubular member 20 in order to allow fluid flow through the inlet and outlet of the tubular member 20. The tubular member 20 has a cross sectional profile corresponding to the cross sectional profile of the longitudinal shaft. For ease of assembly and manufacture, the tubular member 20 includes two separate connecting members, the first connecting member 21 associated with the inlet of the tubular member 20, and the second connecting member 23 associated with the outlet of the tubular member 20. The first connecting member 21 is adapted for coupling with the second connecting member 23 through various means. For example, as shown in FIG. 4, the first connecting member 21 has a threaded end portion on its outer circumferential surface at the opposite end of the inlet 22 capable of receiving a threaded end portion on the inner circumferential surface of the second connecting member 23. Clearly, the threaded end portion of the first connecting member 21 can be on its inner circumferential surface while the threaded end portion of the second connecting member 23 can be on its outer circumferential surface. A skilled person in the art would understand that various other means of coupling the first and second connecting members are possible without departing from the scope of the invention. At the proximal end of the inlet of the first connecting member, the first connecting member 21 is diametrically tapered towards the inlet so that the tapered end is complementary to the first end portion 12 of the longitudinal shaft. The tapered proximal end of the first connecting member 21 adjacent the inlet 22 is to streamline the fluid flow at the inlet towards the airfoil-shaped projecting members 19 of the body and to reduce energy losses. Similarly, at the proximal end of the outlet 24 of the second connecting member 23, the second connecting member is diametrically tapered towards the outlet 24 so that fluid flow can be streamlined with lesser energy loss from the second end portion 14 of the longitudinal shaft towards the outlet 24. FIG. 5 illustrates the first and second connecting members 21, 23 in a state of disassembly to reveal the longitudinal shaft within the tubular member 20. The outside diameter of the longitudinal shaft includes the diameter of the cylindrical body and the length of the externally projected airfoil-shaped projecting members. The outside diameter of the longitudinal shaft is slightly smaller than the diameter of the inner circumference of the tubular member so that the longitudinal shaft is in close proximity to the inner circumferential surface of the tubular member 20. This keeps the fluid flow within the tubular member 20 in close contact with the airfoil-shaped projecting members.

Figure 6:
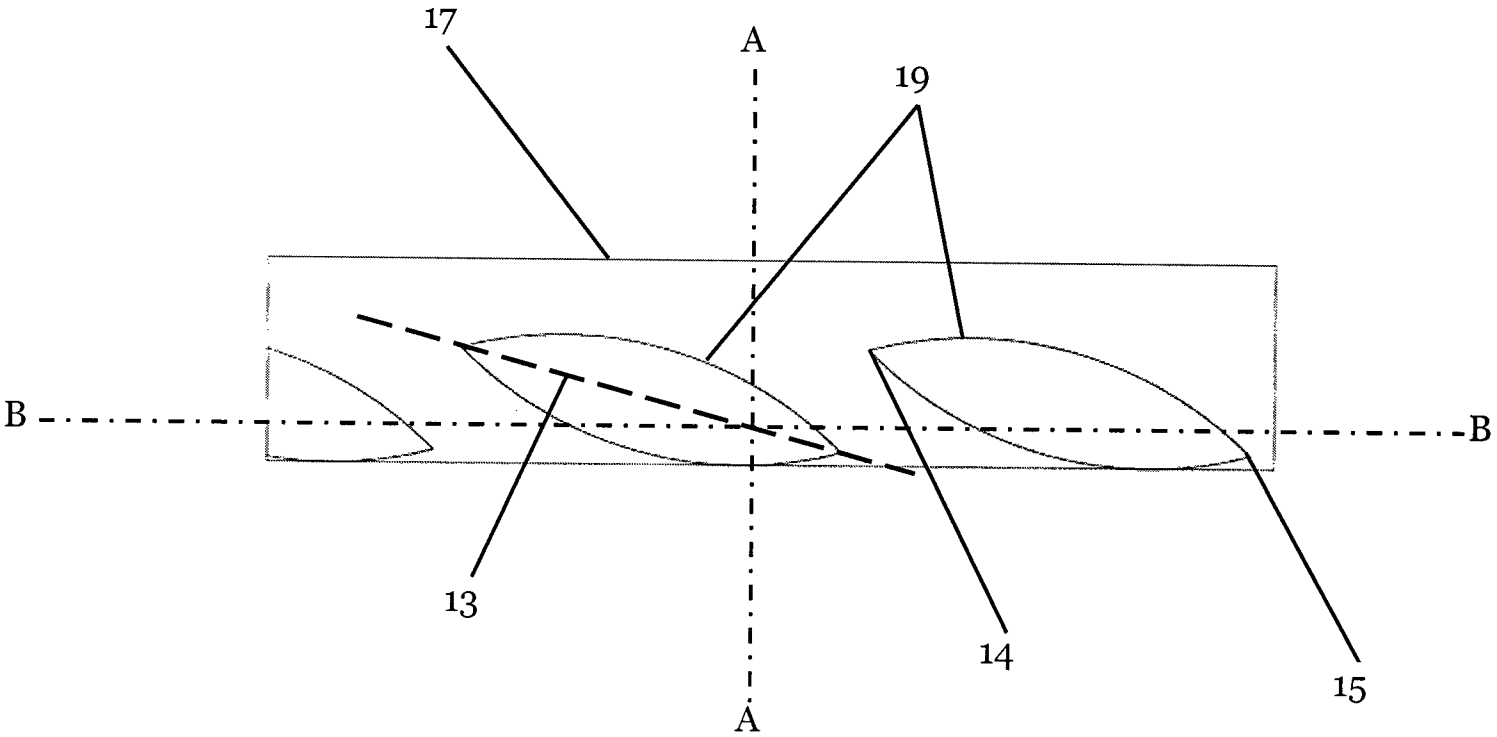
FIG. 6 is a side view of a disc member in accordance with an embodiment of the invention.

FIG. 6 shows a side view of a disc member 17 with its airfoil-shaped projecting members 19. As mentioned above, the airfoil-shaped projecting members 19 are regularly disposed on the outer circumferential surface of the disc member 17 such that they do not overlap each other. The airfoil-shaped projecting member 19 has a leading edge 14 and a trailing edge 15. The chord line 13 is the line joining the leading edge 14 and the trailing edge 15. The chord line 13 of the airfoil-shaped projecting members 19 are inclined at an angle of approximately 15 degrees from the longitudinal axis (B-B) of the disc member 17 or inclined at an angle of approximately 75 degrees from the axis A-A of the disc member 17. In other words, the angle of incline is the angle of attack of the fluid with the airfoil-shaped projecting member. The angle of incline can range from between 10-25 degrees relative to the longitudinal axis B-B of the disc member 17 or 65 to 80 degrees from the axis A-A of the disc member 17. The airfoil-shaped projecting members 19 also protrude radially from the outer circumferential surface of the disc member 17. The length of protrusion of the airfoil-shaped projecting members from the surface of the disc member 17 is related to the diameter of the disc member 17, the fluid flow rate and the pressure of the fluid flow inlet. A skilled person would therefore understand that many combinations of the length of protrusion with respect to the diameter of the disc member 17 is possible due to the relationship with the aforesaid parameters.

Figure 7:
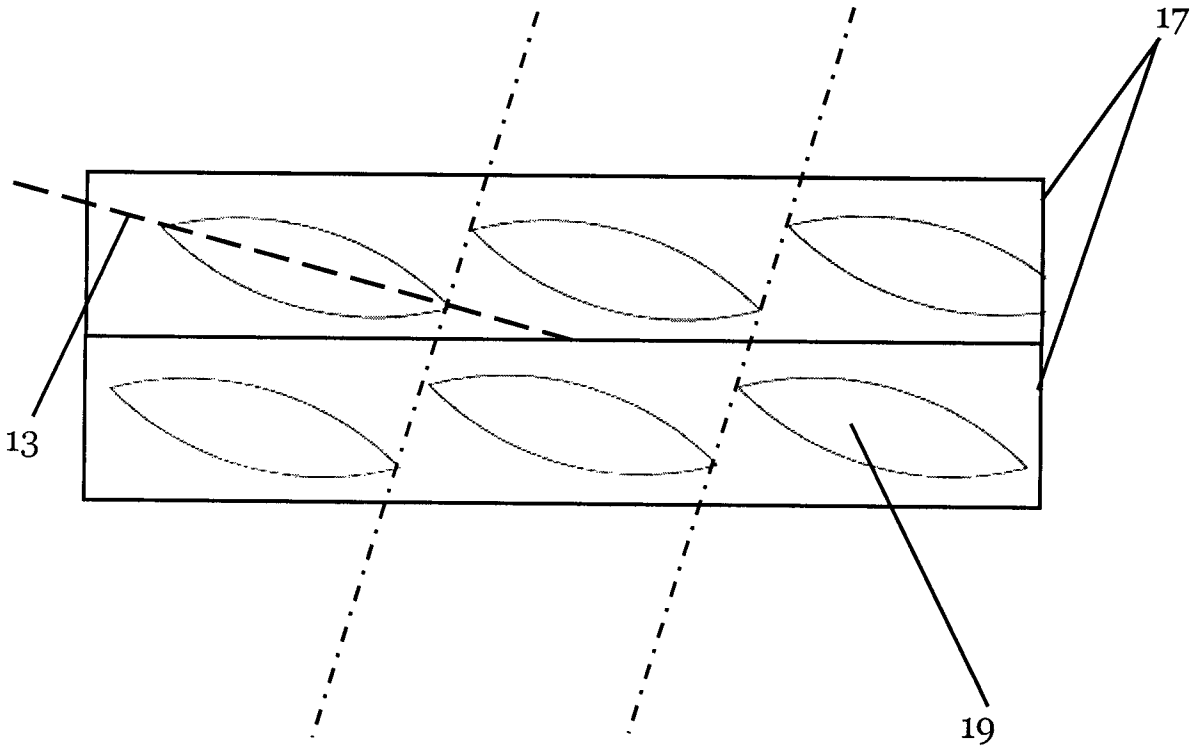
FIG. 7 is a side view of two disc members assembled together in accordance with an embodiment of the invention.

FIG. 7 illustrates two disc members 17 connected together and the airfoil-shaped projecting members 19 arranged in a predetermined manner. The orthogonal line to the chord line of the airfoil-shaped projecting member 19 is the basis for the alignment of the airfoil-shaped projecting members between adjacent disc members. Therefore, depending on the angle of incline of the airfoil-shaped projecting members 19, the orthogonal line to the angle of incline determines the alignment of the airfoil-shaped projecting members between adjacent disc members 17. The orthogonal lines to the chord line are at the leading edge and the trailing edge of the airfoil-shaped projecting member 19. The airfoil-shaped projecting members 19 of the adjacent disc members will therefore fall within the orthogonal lines of the projecting member. In other words, the resulting effect of the alignment is that the airfoil shaped projecting members 19 of adjacent disc members 17 are aligned in a diagonal manner.

FIG. 8 illustrates a top view of the disc member 17 and its airfoil-shaped projecting members 19. In this embodiment, a throughhole 13 is disposed in the centre of the disc member 17 for allowing a rod to be inserted to hold a plurality of disc members 17 together.

Figure 9:
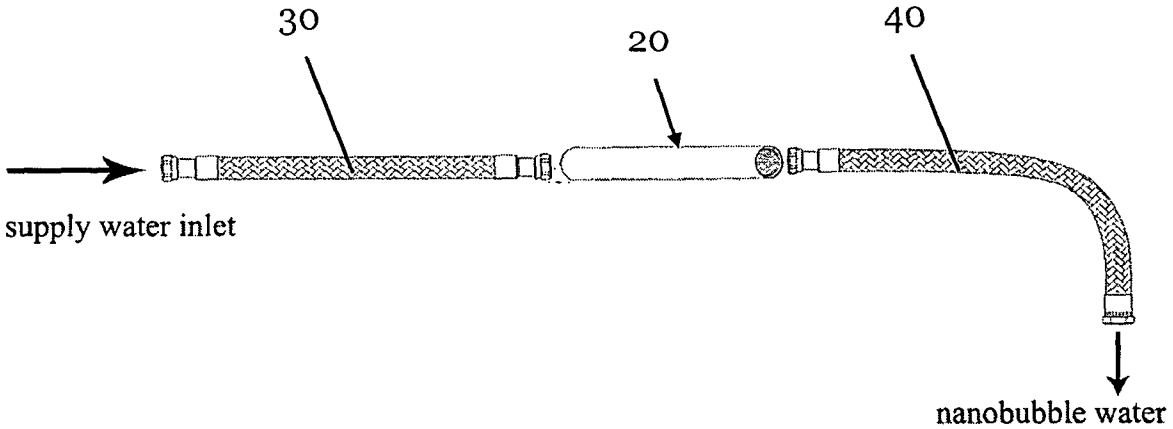
FIG. 9 illustrates the apparatus when in use in accordance with an embodiment of the invention.

FIG. 9 illustrates the apparatus 10 when connected to a fluid supply inlet and an outlet for the exit of nano bubbles generated by the apparatus 10. The fluid supply inlet and outlet can be in the form of a flexible hose or water fixture. In use, the apparatus 10 together with its tubular member 20 is adapted for connection to flexible hoses 30, 40 at its inlet and outlet of the tubular member 20. The fluid inlet pressure at the fluid supply inlet is preferably between 0.5 bars to 6 bars. When water flows through the fluid supply inlet, it enters the inlet 22 of the tubular member 20. The fluid flow is guided by the conical-shaped guide 12 proximal to the inlet of the longitudinal shaft and fed into the airfoil-shaped projecting members 19 of the body. When the fluid flow passes through the flow passage between two airfoil-shaped projecting members 19, the fluid converges and experiences a Venturi effect in that the velocity of the fluid flow increases as it passes through the airfoil-shaped projecting members 19. As fluid flow leaves the flow passage, it encounters a divergent flow from another airfoil-shaped projecting member in its path which splits the fluid flow through the subsequent flow passages. The repeated convergent and divergent flow of fluid through the multiple flow passages causes velocity and pressure fluctuation and accelerates the formation of vortexes known as the Coanda effect. This causes the cavitation of nano bubbles from the fierce whirl created from the fluid flow through the multiple flow passages. The fluid flow swirls through the flow passages in less than two cycles (see FIG. 8 and above) and is guided by the conical shaped guide at the outlet of the tubular member 20. The fluid flow that exits the tubular member 20 will contain numerous nano bubbles.

In the area of microelectronics, the wafer cleaning process is a series of tedious and lengthy process of several processing steps. Some steps of the wafer cleaning process require removal of organic contaminants from the wafers by soaking them in large amounts of deionized water (DI water). The use of nano bubble technology in the wafer cleaning process can provide benefits in shortening the time taken for the cleaning process. The slow rise rate and the extended suspension rate of nano bubbles in water will allow the minute impurities particles that adhere to the wafer to be attracted to the nano bubbles on contact of the nano bubbles-filled water with the wafer. The nano bubbles will cause the impurities to separate from the wafer upon collapse of the nano bubbles, thereby neutralizing the impurities. Therefore, the use of nano bubbles-filled water in cleaning silicon wafers can improve the efficiency of the wafer cleaning process by reducing rinsing time and amount of water used for the cleaning process.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

The invention claimed is:

1. An apparatus for generating nanobubbles for use with fluid dispensing fittings, the apparatus comprising:

a longitudinal shaft having a first end portion, a body and a second end portion, the first end portion and the second end portion adapted for connection with the body, the first end portion and the second end portion each having a conical-shaped guide;

wherein the body comprises airfoil-shaped projecting members arranged circumferentially on an outer circumferential surface of the body;

wherein each of the airfoil-shaped projecting members includes a leading edge, a trailing edge, opposed curved surfaces extending between the leading edge and the trailing edge, and a chord line extending between the leading edge and the trailing edge; and wherein the leading edge of each of the airfoil-shaped projecting members is inclined at an angle of approximately 75 degrees with respect to a longitudinal axis of the body.

2. The apparatus according to claim 1, wherein the airfoil-shaped projecting members are disposed circumferentially at a predetermined interval from one another in the circumferential direction and the airfoil-shaped projecting members are disposed longitudinally at a predetermined interval from one another in the longitudinal direction of the body.

3. The apparatus according to claim 1, wherein adjacent ones of the airfoil-shaped projecting members in the circumferential direction are disposed circumferentially such that the airfoil-shaped projecting members do not overlap one another to form gaps for fluid flow therebetween.

4. The apparatus according to claim 1, wherein the airfoil-shaped projecting members extend radially outward from an outer circumferential surface of each disc member of the plurality of disc members.

5. The apparatus according to claim 1, wherein the leading edge of each of the airfoil-shaped projecting members is inclined at an angle between 65 and 80 degrees with respect to a longitudinal axis of the body.

6. An apparatus for generating nanobubbles for use with fluid dispensing fittings, the apparatus comprising:

a longitudinal shaft having a first end portion, a body and a second end portion, the first end portion and the second end portion adapted for connection with the body, the first end portion and the second end portion each having a conical-shaped guide;

wherein the body comprises airfoil-shaped projecting members arranged circumferentially on an outer circumferential surface of the body;

wherein the body further includes a plurality of disc members, each of the plurality of disc members adapted for connection with one another to form the body; and wherein each of the airfoil-shaped projecting members on each of the plurality of disc members includes a leading edge, wherein the leading edge is inclined at an angle of approximately 75 degrees with respect to a longitudinal axis of the body.

7. The apparatus according to claim 6, wherein the airfoil-shaped projecting members on each of the plurality of disc members are disposed circumferentially at a predetermined interval from one another to form gaps for fluid flow therebetween.

8. The apparatus according to claim 6, wherein the airfoil-shaped projecting members on each of the plurality of disc members are disposed circumferentially such that the projecting members do not overlap one another to form gaps for fluid flow therebetween.

9. The apparatus according to claim 6, wherein the airfoil-shaped projecting members protrude radially outward from the outer circumferential surface of each of the plurality of disc members.

10. The apparatus according to claim 6, wherein each of the airfoil-shaped projecting members on each of the plurality of disc members includes the leading edge, a trailing edge, opposed curved surfaces extending between the leading edge and the trailing edge, and a chord line extending between the leading edge and the trailing edge.

11. The apparatus according to claim 6, wherein each of the airfoil-shaped projecting members on each of the plurality of the discs includes a chord line, wherein the chord line is inclined at an angle of approximately 15 degrees with respect to a longitudinal axis of the disc.

12. The apparatus according to claim 11, wherein the chord line of each of the airfoil-shaped projecting members is the line joining the leading edge and a trailing edge.

* * * * *